US006653787B2

(12) United States Patent
Watkins et al.

(10) Patent No.: US 6,653,787 B2
(45) Date of Patent: Nov. 25, 2003

(54) HIGH POWER DENSITY MULTISTAGE DEPRESSED COLLECTOR

(75) Inventors: Raymond F. Watkins, San Mateo, CA (US); Richard Brownell True, Sunnyvale, CA (US)

(73) Assignee: L-3 Communications Corporation, San Carlos, CA (US)

( * ) Notice: Subject to any disclaimer, the term of this patent is extended or adjusted under 35 U.S.C. 154(b) by 0 days.

(21) Appl. No.: 10/091,433

(22) Filed: Mar. 5, 2002

(65) Prior Publication Data

US 2003/0168985 A1 Sep. 11, 2003

(51) Int. Cl.[7] ..... H01J 23/02; H01J 25/00
(52) U.S. Cl. ..... 315/5.38; 315/3.5
(58) Field of Search ..... 315/3.5, 3.6, 5.38, 315/39.59, 39.63, 39.77

(56) References Cited

U.S. PATENT DOCUMENTS

| | | | | |
|---|---|---|---|---|
| 3,540,119 A | | 11/1970 | Manoly | |
| 3,586,100 A | | 6/1971 | Yasuda et al. | 165/80.3 |
| 3,736,658 A | * | 6/1973 | Weaver et al. | 29/887 |
| 3,823,772 A | * | 7/1974 | Lavering et al. | 165/81 |
| 3,930,182 A | | 12/1975 | Bretting | 315/3.5 |
| 3,949,263 A | * | 4/1976 | Harper | 315/3.5 |
| 4,358,706 A | | 11/1982 | Nazet et al. | 315/5.38 |
| 4,387,323 A | * | 6/1983 | Berwick | 315/5.35 |
| 6,291,935 B1 | * | 9/2001 | Suzuki et al. | 315/5.38 |
| 6,300,755 B1 | * | 10/2001 | Elmer et al. | 324/71.3 |
| 6,320,315 B1 | * | 11/2001 | Watkins | 315/5.38 |

FOREIGN PATENT DOCUMENTS

| | | |
|---|---|---|
| EP | 0 276 933 | 8/1988 |
| EP | 0 924 740 | 6/1999 |

* cited by examiner

*Primary Examiner*—Don Wong
*Assistant Examiner*—Minh D A
(74) *Attorney, Agent, or Firm*—O'Melveny & Myers LLP

(57) ABSTRACT

A collector for a linear beam has a segmented ceramic collector core that permits sustained operation at high temperatures and power densities. The collector provides efficient heat transfer from the while reducing stresses on collector components caused by thermal cycling and comprises a heat sink having a cavity providing interior vacuum walls for the collector a segmented ceramic insulator disposed inside the cavity, and an electrode disposed inside and against the insulator. The insulator comprises sectors separated from one another by gaps, and may be notched in its outer surface for high-voltage stand-off from the sink. The electrode is preferably not brazed/soldered to the insulator. A stage of the electrode may be probeless and comprise a depression. A molybdenum-fabricated heat sink and stage assembly utilizes an insulator constructed from beryllium oxide, aluminum nitride, or alumina; alternatively, a copper assembly, uses an aluminum nitride insulator.

22 Claims, 3 Drawing Sheets

FIG. 1
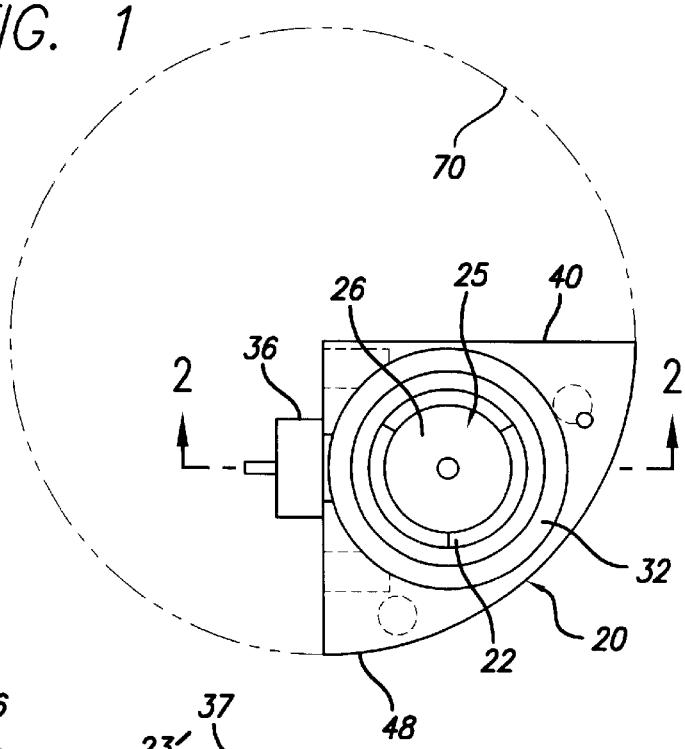
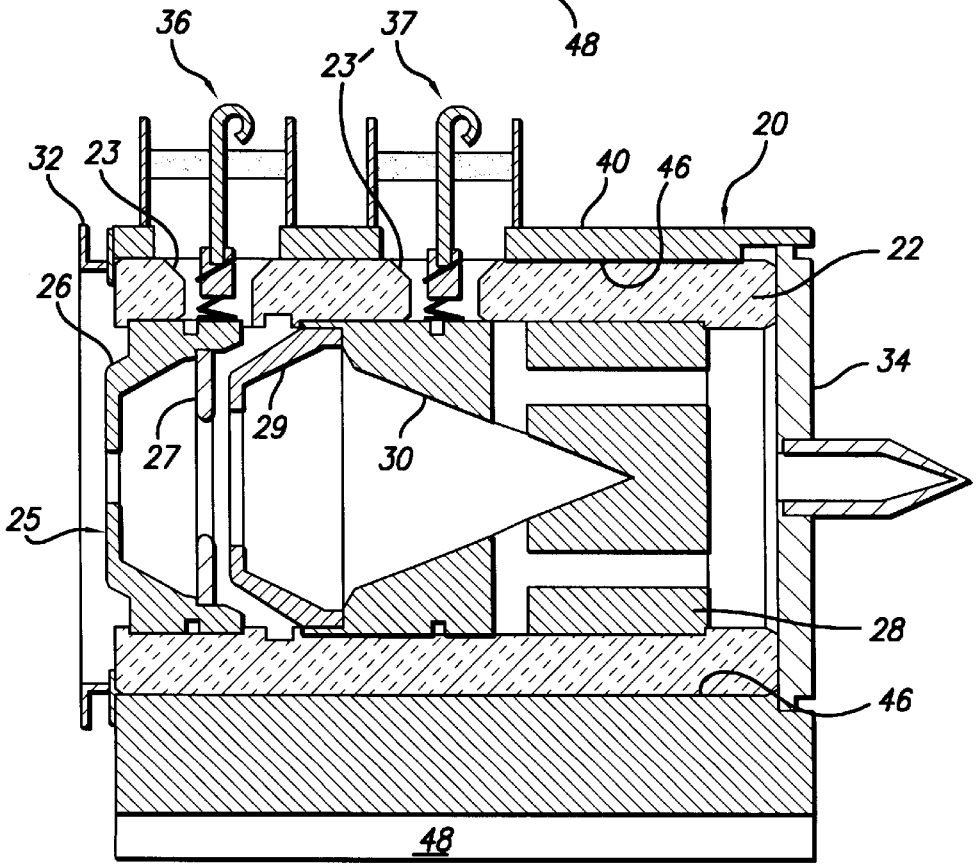
FIG. 2

HIGH POWER DENSITY MULTISTAGE DEPRESSED COLLECTOR

BACKGROUND OF THE INVENTION

1. Field of the Invention

The present invention relates to collector assemblies used for collecting spent electrons in linear beam electron devices. More particularly, the invention is directed to a multistage depressed collector and mounting structure for miniature traveling wave tubes used in elevated temperature environments, such as airborne applications.

2. Description of Related Art

Linear beam electron devices, such as traveling wave tubes, are well known in the art for generating and amplifying high frequency signals. In a linear beam device, an electron gun comprising a cathode and an anode generates a linear beam of electrons. The generally cylindrical electron beam passes through an interaction structure in which a portion of the beam energy is transferred to an electromagnetic signal within the interaction structure. After exiting from the end of the interaction structure, the spent electrons of the beam pass into a collector structure that decelerates and captures the electrons in order to recover a portion of their remaining energy. Electrodes disposed within the collector structure are used to collect the spent electrons at close to their remaining energy in order to return power to the source powering the linear beam electron device. Collector structures thereby increase the overall DC to RF conversion efficiency of traveling wave tubes and other linear beam electron devices. Unrecovered beam energy is transformed into heat within the collector. To avoid overheating of the collector, this heat must be transferred out of the collector and dissipated to the external environment via a heat sink or like device.

Collector structures generally comprise a central electrode structure supported by a core of thermally rugged electrical insulating material, such as a ceramic material. The ceramic insulating material may be housed in a metal cylinder or sleeve, which is in turn fitted within a relatively massive heat sink. The core insulates the electrode electrically from ground and provides voltage isolation between electrode stages. In addition, the insulating material conducts waste heat from the electrodes to the outer housing and heat sink. The outer housing further provides a vacuum wall for the linear beam electrode device.

Collector structures of this basic type are known as depressed dual stage and multistage designs. Electrons on a spent beam are typically distributed over a range of spectral energies. The lowest-energy electrons are collected in a first, least-depressed stage electrode of the collector, and higher energy electrons progress to a second or subsequent stage electrode. The power density of collected electrodes may be particularly high in the second stage electrode. High power densities, in turn, can create thermal stresses in the collector that may cause collector failure due to melting or cracking of the insulators that support the second stage electrode. Thermal stresses are particularly high for traveling wave tubes that operate in high temperature environments, such as greater than about 200° C.

In prior art assemblies, thermal stresses often arise from differences in rates of thermal expansion between the ceramic core and heat sink. In particular, the metal heat sink expands at a higher rate than the ceramic core, reducing heat transfer between the heat sink and the core. The reduced heat transfer to the heat sink increases the operating temperature of the core. This, in turn, can cause cracking of the ceramic core caused by expansion of the inner metallic electrode, or even melting of an electrode. In theory, these problems may be reduced by constructing the entire collector for assembly at the anticipated operating temperature. However, assembling the entire collector in an elevated temperature environment is not practical. Also, collector components, even if assembled at operating temperature, are still subject to cyclical stresses from excursions below or above the anticipated operating range.

A different type of collector assembly is disclosed in U.S. Pat. No. 6,320,315. A sleeve is comprised of a material having a rate of thermal expansion different from that of the heat sink and is disposed in close contact with the heat sink when the collector is at an elevated operational temperature. A slight gap is defined between the collector core and the sleeve when the collector is at an ambient temperature, and the collector core is in close contact with the sleeve when the collector is at the operational temperature. The electrode assembly is of a conventional design. The heat sink further comprises either copper or aluminum, the sleeve is comprised of molybdenum, and the collector core is comprised of a ceramic material. To assemble the collector structure, the heat sink is heated to a temperature above the operational temperature, and the sleeve is inserted. The ceramic core is then inserted into the sleeve at an ambient temperature. Although this design provides useful benefits, further cost reductions and performance improvements are still desirable.

It is therefore desired to provide a collector structure having a ceramic collector core that permits sustained operation at high temperatures and high power densities, such as encountered in miniature traveling wave tubes. More particularly, a collector assembly that provides efficient heat transfer from the collector core at elevated temperatures is desired while reducing stresses on collector components caused by thermal cycling. It is further desired to avoid concentrated power densities in the second stage electrode. In addition, the collector assembly should be relatively inexpensive to construct.

SUMMARY OF THE INVENTION

The present invention provides a novel collector structure for a linear beam device that overcomes the limitations of the prior art using a new and innovative design. The collector structure comprises a heat sink having a vacuum cavity, a segmented ceramic insulator within the cavity, and an electrode assembly within the ceramic insulator.

The collector includes a ceramic insulator (core) that is segmented into two or more (such as three) preferably axisymmetric sectors that fit together to surround the collector electrodes. A notched butt joint is preferably used at the interfaces between the ceramic pieces to maintain electrical isolation of the electrode and to reduce concentrated electric fields in the ceramic throughout the operating temperature range. The notches provide reliable high voltage standoff. The individual segments of the ceramic insulator are not attached to one another. No sleeve is needed between the ceramic and. the heat sink, and the ceramic insulator is preferably inserted directly into a cavity of the heat sink.

In an embodiment of the invention, molybdenum is used for the second stage collector electrode. A probeless electrode shape with a deep rear taper is preferably used to reduce power densities in the collector and provide better power dissipation. The first stage electrode may be comprised of copper and be conventionally shaped.

The heat sink may be comprised of a molybdenum material, instead of conventionally-used copper or aluminum. Preferably, the heat sink also provides the vacuum wall for the collector. Molybdenum is preferred because it is a refractory material with a low coefficient of thermal expansion, good thermal conductivity, and low vapor pressure at elevated temperatures. An outside surface of the heat sink may be shaped to conform to a round shaped air cooled surface, or such as an outer surface of a final assembly, thereby eliminating a thermal interface and improving heat exchange to the external environment.

In an alternative, lower-cost embodiment, copper may be used for all of the electrode stages, and copper is also used for the heat sink material. The heat sink, insulator, and electrode are sized such that the insulator and the electrode are compressed by the heat sink at ambient temperature and throughout the operating range of the collector. The remaining aspects of the collector may remain substantially the same as for the molybdenum collector and heat sink. Advantageously, copper is less expensive than molybdenum materials, although not as ideally suited for high-temperature, high power density operation.

The present invention provides several advantages. The segmentation of the ceramic insulator relieves thermal stresses on the ceramic while maintaining good heat conduction to the heat sink over a wide range of operating temperatures. In an embodiment of the invention, the electrode and the heat sink expand and contract at approximately the same rate, and so the pressure exerted on the ceramic insulator between these components remains relatively constant. In the alternative, the electrode has a different coefficient of expansion, preferably a higher coefficient of expansion, than the heat sink. For example, a copper electrode may be used with a molybdenum heat sink. In such embodiments, the compression on the ceramic insulator will increase with temperature, advantageously improving thermal contact between the electrode and the heat sink as the collector heats up.

The ceramic is preferably sized to be in contact with both the heat sink and the electrode at ambient temperature and throughout the desired operating range. Annular gaps between the ceramic insulator and the heat sink or between the insulator and the electrode may cause undesirable electric field concentration and less than optimal heat conduction, and should therefore be avoided.

The ceramic insulator typically has a different coefficient of expansion than metals, including copper and molybdenum materials. In conventional collector designs, this mismatch of expansion rates would cause thermally-induced mechanical stresses and changes in heat transfer characteristics of the collector assembly over the operating temperature range. In the present invention, the free-floating (i.e., unbrazed), segmented ceramic insulator is compressed between the expanding electrode and the heat sink as the temperature increases. The ceramic segments are subjected mainly to compressive stresses, for which ceramic materials are typically exceeding strong. Little or no tensile stress can occur because the insulator is segmented. Meanwhile, good thermal contact is maintained between the electrode and the heat sink throughout the operating range. The braze-less design also allows for a wider selection of ceramic materials.

A further benefit of the invention is that the collector assemblies are relatively easy to assemble. It is not required to heat the components of the present invention in order to assemble them. The collector electrode stages may be fit together in interlocking relationship with the sections of the ceramic insulator. The assembled electrode and insulator may then be inserted together into the heat sink at ambient temperature. The assembly may then be held in place by seal flanges which may be brazed to the heat sink at the front and rear of the collector. The rear seal flange includes an end cap. Because the heat sink provides the vacuum wall, only a single braze operation is needed during assembly, to attach the seal flanges to the heat sink. Unlike prior art designs, the electrodes need not be brazed to the ceramic core.

A more complete understanding of the collector assembly will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 1 is an end view of an exemplary collector assembly according to the invention, showing the heat sink with an airfoil surface.

FIG. 2 is a cross-sectional view of an exemplary collector assembly according to the invention.

DETAILED DESCRIPTION OF THE PREFERRED EMBODIMENT

Figure 3:
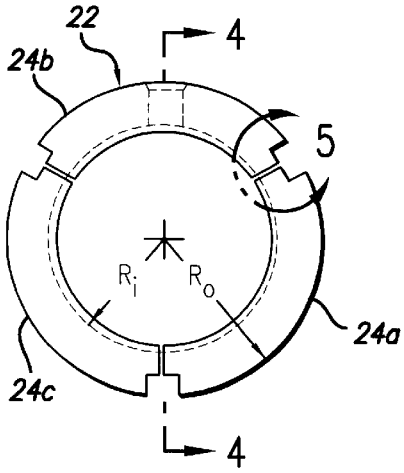
FIG. 3 is an end view of an exemplary ceramic insulator.

The present invention provides a novel collector structure, comprising a heat sink having a cylindrical cavity, a segmented ceramic insulator within the cavity of the heat sink (replacing the ceramic core of prior art collectors), and an electrode assembly inside the segmented ceramic insulator. In the detailed description that follows, like element numerals are used to identify like elements that appear in one or more of the figures.

An end view of an exemplary collector assembly 20 is shown in FIG. 1. The drawing scale is arbitrary and is shown enlarged with respect to the scale of a typical miniature high-density collector structure for an airborne application. The present invention is not limited to any particular size or scale of device. Although particularly suitable for miniature linear electron beam devices, the invention may be adapted for use in collector structures of various sizes.

The collector assembly 20 comprises three principle components: an inner electrode 25, an outer heat sink 40, and a ceramic insulator 22 intermediate between the electrode and the heat sink. These components may be arranged in a concentric annular structure, as shown in FIG. 1. As is typical of linear beam devices, the electrode 25, of which only the first stage (forward) electrode 26 is visible in this view, and the ceramic insulator 22 are substantially radially symmetrical components. However, the invention is not limited to radially symmetrical electrodes and insulators. A segmented ceramic insulator 22 surrounds the electrode 25. A relatively massive heat sink 40 surrounds the ceramic insulator. Voltage and current are supplied to the electrode via the power connection assembly 36.

The ceramic insulator 22 and electrode 25 are inside a corresponding cavity in heat sink 40. The interface between the cavity of the heat sink and the ceramic insulator is covered by a forward vacuum seal 32, which is brazed to the heat sink 40. Vacuum seal 32 may then be sealed to the remainder of the linear beam device (not shown). The power connection assembly 36 is constructed to maintain a vacuum within the cavity of heat sink 40. Heat sink 40 may be shaped to occupy a portion of a larger component, such as an airborne radiator. The heat sink 40 preferably has an external surface 48 that conforms to and blends with an airfoil surface of the larger component, for example the airfoil surface indicated in FIG. 1 by the phantom line 70. A proportionally large area of the heat sink is preferably in direct contact with the ambient temperature environment for efficient heat exchange.

FIG. 2 is an enlarged cross-sectional view of the collector assembly 20 taken along the line 2—2 shown in FIG. 1. The scale of FIG. 2 is about twice as large as shown in FIG. 1. The vacuum wall of the cavity 46 in heat sink 40 is visible adjacent to the outer wall of the ceramic insulator. A vacuum seal is maintained at the rear of the collector by rear seal 34, which is brazed to heat sink 40 around the periphery of seal 34. Ceramic insulator 22 is retained between forward seal 32 and rear seal 34. Preferably, the insulator is not brazed or soldered to any other part of the collector assembly 20, thereby easing assembly operations and making a wider selection of ceramic materials available. For example, aluminum nitride may be used instead of less economical beryllium oxide. Heat sink 40 may be a machined block of material. A portion of airfoil surface 48 is shown near the bottom of FIG. 2.

Preferably, an outer surface of the ceramic insulator 22 abuts and contacts the wall of cavity 46 in heat sink 40, and an inner surface of the ceramic insulator abuts and contacts the electrode 25. In particular, the ceramic insulator abuts and contacts the peripheral surface of the second stage (rear) electrode 28. To assemble the collector assembly, the appropriately sized segments of the ceramic insulator are placed around the electrode 25. Components of the electrode 25, such as rear electrode 28 and forward electrode 26, are axially retained by annular shoulders on the interior wall of the ceramic insulator 22. The assembled ceramic insulator and electrode may then be slid into the cavity of the heat sink at ambient temperature.

Precise tolerances are preferably used for the fit between the ceramic insulator and the electrode, and between the ceramic insulator and the cavity of the heat sink. For example, in an embodiment of the invention using a molybdenum heat sink, the assembled ceramic insulator and electrode may fit within the cavity with a close sliding fit or an LC1 clearance fit, as known in the art. Interference fits are not preferred because of the difficulty of assembly. Any gap between the electrode and the wall of cavity 46 or the peripheral surface of the second electrode at ambient temperature is preferably as small as possible to permit assembly. For example, in the collector assembly of FIG. 2, any gap is preferably less than about 0.0016 inches (about 0.04 mm), and more preferably, less than about 0.0004 inches (about 0.01 mm), to prevent concentrated field gradients that may lead to high-voltage breakdown, and to improve thermal conduction through the ceramic insulator. As the collector assembly heats up during operation, any small gap should quickly disappear.

Electrode 25 may comprise various components as known in the art. For example, a first-stage electrode 26, a baffle 27, a nose 29 for the second-stage electrode 28, and the second-stage electrode 28 itself are used in assembly 20. In an embodiment of the invention, the second-stage electrode is made of molybdenum and the remaining components of electrode 25 are copper. In an alternative embodiment, all of the electrode components are copper. The invention is not limited to the use of copper or molybdenum, and other suitable electrode materials may also be used for components of electrode 25. For example, alternative electrode materials may include tungsten, various elconites, POCO graphite (carbon), and various other materials.

In an embodiment of the invention utilizing a copper electrode 25 and a copper heat sink 40, the relatively high compressive strength of ceramic relative to copper is utilized to achieve a compression fit of the ceramic-electrode subassembly inside of the heat sink. The copper heat sink will expand a relatively large amount at a relatively low temperature, as compared to a molybdenum heat sink. The electrode and ceramic can be sized for an interference fit with the cavity 46 of the heat sink, and inserted into the heat sink while it is at a high temperature, such as just prior to brazing. The end seals 32, 34 and power connectors 36, 37 can be brazed in place to seal the assembly, and the unit allowed to cool. As it cools, the heat sink compresses the electrode 25, and eliminates any gap between the ceramic insulator and the inner electrode and outer heat sink.

Power connections 36, 37 are brazed or soldered to heat sink 40, insulated, and sealed as known in the art. Power connection 36 is connected to the first-stage electrode 26. Power connection 37 is connected to second-stage electrode 28. Connections 36, 37 pass through openings 23, 23', respectively, in ceramic insulator 22. Any number of electrode stages may be used, although two stages are typical. Details of the power connections may otherwise be as known in the art, and the invention is not limited thereby.

Figure 4:
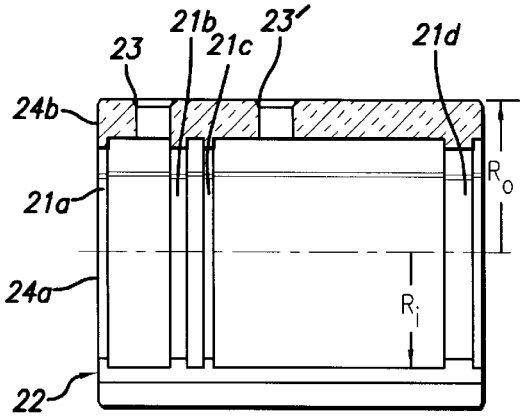
FIG. 4 is a cross-sectional view of the ceramic insulator shown in FIG. 3.

FIG. 3 is an end view of an exemplary ceramic insulator 22. FIG. 4 is a cross-sectional view of the ceramic insulator. Insulator 22 is comprised of separate segments 24*a*, 24*b*, and 24*c* which are shown in an assembled position to form a substantially cylindrical shape. It should be appreciated, however, that the individual segments 24*a–c* are not attached to one another, and any number of segments may be used to surround the electrode and insulate it from the heat sink 40. The individual segments may be substantially identical, like segments 24*a–c* which are identical except for the holes 23, 23' through segment 24*b* for the power connections. Segmenting the insulator 22 reduces thermally induced mechanical stress on the insulator during operation and also facilitates braze-free assembly to the electrode.

Each segment 24*a–c* has a nominal inner radius $r_i$ to match a corresponding radius of the electrode 25, and a nominal outer radius $r_o$ to match a corresponding radius of the cavity 46 in heat sink 40. For example, for one exemplary collector design, $r_i$ may be about 0.23 inches (about 5.8 mm), $r_o$ may be about 0.33 inches (about 8.4 mm), and the insulator 22 may be about one inch (about 25 mm) long. Of course, the collector assembly and its components may be made in various sizes and proportions, without departing from the scope of the invention. As previously described, the exact values of the radiuses $r_i$, $r_o$ may further depend on the type of fit (clearance or interference) desired with the heat sink.

The wall thickness of the insulator (i.e., $r_o$–$r_i$) is selected depending on the amount of electrical insulation required, which depends in turn on the voltage of the electrode and the insulating value of the ceramic material selected for the insulator. The wall thickness is preferably not made thicker than required for electrical insulation, for optimal thermal conduction. The assembled insulator 22 is not a load-carrying structure, except for compressive loads for which ceramic materials are quite strong. However, the structural characteristics of the insulator segments may be of concern because thermally-induced stresses may arise from varying temperatures along the length of the electrode during operation. Also, structural strength may be a consideration while forming the insulator segments, and during assembly.

Each segment may include features on its inner or outer surface for assembly of the insulator 22 to the electrode 25 or to the heat sink. For example, insulator segment 24*a* is provided with four internal shoulders 21*a–d* as shown in FIG. 4, for retaining the components of the electrode 25 against axial displacement. The remaining segments 24*b–c* may be provided with corresponding shoulders that cooperate to form retention rings around the electrode components when the segments are assembled.

Very high purity (99.5%) beryllium oxide (BeO) is a preferred material for ceramic insulator 22 in very high power density applications, because it is stronger and more thermally conductive than lower purity BeO. High purity BeO is difficult to braze, but this is not disadvantageous for the present invention, which does not require brazing the insulator. In general, BeO is relatively expensive and requires special precautions in handling. Alternative ceramic materials may include aluminum nitride (AlN) and alumina ($Al_2O_3$), both of which are less costly than beryllium oxide and which are suitable for many applications.

Figure 5:
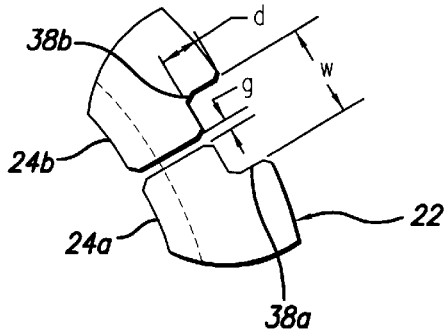
FIG. 5 is a detail view of a notch and gap between adjoining segments of an insulator.

In their assembled position, the segments 24*a–c* preferably are separated by a gap and are notched to provide a stand-off from the heat sink at their adjoining edges. FIG. 5 is a detail view of an exemplary notch and gap between adjoining segments 24*a*, 24*b* of insulator 22. The gap between segments 24*a* and 24*b* has a width "g" that may vary. For example, in an insulator for the exemplary collector described above, a gap "g" of 0.010 to 0.030 inches (about 0.25–0.75 mm) should not substantially impair the electrical insulating properties of the ceramic insulator 22. A gap of fairly substantial width, such as 0.020 inches, may be preferable to ensure that gas is not trapped in any space between adjoining segments during assembly, and to prevent interference between adjoining segments.

The segments are also preferably notched with an axial notch along the outer surface of each segment edge. An enlarged cross-section of notches 38*a*, 38*b* are shown in FIG. 5. The notches 38*a*, 38*b* span a width "w" radially, and extend a depth "d" into the wall of the segments 24*a*, 24*b*. Continuing the foregoing example, a width "w" of about 0.090 inches (about 2.3 mm) and a depth "d" of about 0.035 inches (about 0.9 mm) may be suitable for the exemplary collector described above. Various other sizes, proportions, and shapes of notches are believed suitable, and may be used without departing from the scope of the invention. Whatever the geometry of the insulator segments, the shape and size of the notches should be carefully determined to minimize field and junction effects which can lead to high voltage breakdown, especially when the ceramic insulator is hot. Analytical and computational tools such as are known in the art may be used to estimate the effect that a particular shape of notch will have on the electrostatic field across the insulator.

Figure 6:
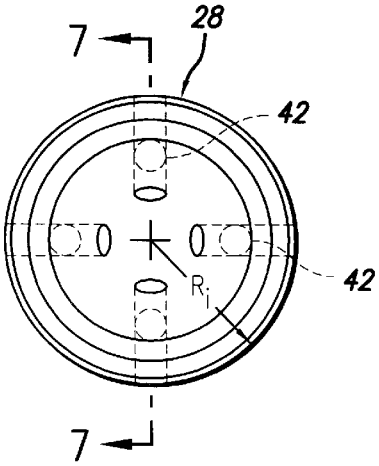
FIG. 6 is a rear end view of a second stage of an exemplary collector electrode.
Figure 7:
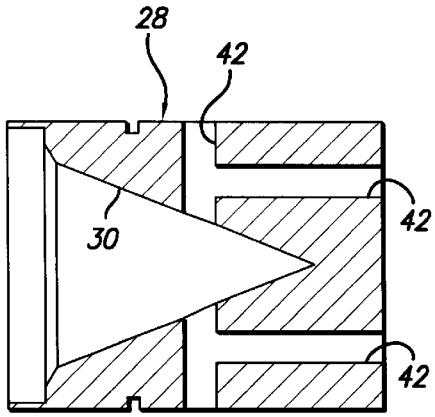
FIG. 7 is a cross-sectional view of the collector electrode shown in FIG. 6.

FIG. 6 is a rear end view of a second stage (rear) electrode 28 of an exemplary collector electrode 25. FIG. 7 is a cross-sectional view of the collector electrode shown in FIG. 6. The rear electrode is cylindrical in shape with an outer radius nominally equal to the inner radius $r_i$ of the ceramic insulator 22.

The highest power densities in the collector generally occur in the second-stage electrode. To more evenly diffuse power in the second stage electrode and prevent concentrated power rings that may overheat and overstress the electrode and insulator, the internal shape of rear electrode 28 preferably does not have a probe (rear protrusion) and includes a deep tapered recess 30. The tapered recess 30 is centered on the axis of the electrode 28 and has a forward opening that matches the internal diameter of the nose 29 (shown in FIG. 2). The tapered recess preferably has a depth-to-diameter, aspect ratio of at least one. That is, the depth of recess 30 is preferably equal to or greater than its diameter at its opening. Holes 42 are provided for evacuation of air during assembly of collector 20.

Molybdenum is a preferred material for the second stage electrode 28 because of its low coefficient of thermal expansion, good thermal conductivity, and low vapor pressure at elevated temperature. These properties enable collector operation at higher temperatures. Molybdenum also has a relatively low secondary emission coefficient δ, which is a desirable property for increasing collector efficiency. For less demanding applications, copper may be used.

Elimination of a requirement to braze the electrode 25 advantageously makes a wider selection of materials available. Other materials that may be used in the electrode include tungsten, carburized tungsten, various elconites, POCO graphite (carbon), and various other materials. One suitable elconite is a sintered tungsten carbide matrix infiltrated with copper. The copper may be removed just from the surface of the electrode by etching which results in a rough, porous, very low-δ surface. In combination with electrodes made from these materials, the heat sink 40 may be made from molybdenum, copper, the other materials identified in this paragraph, or other suitable materials.

Figure 8:
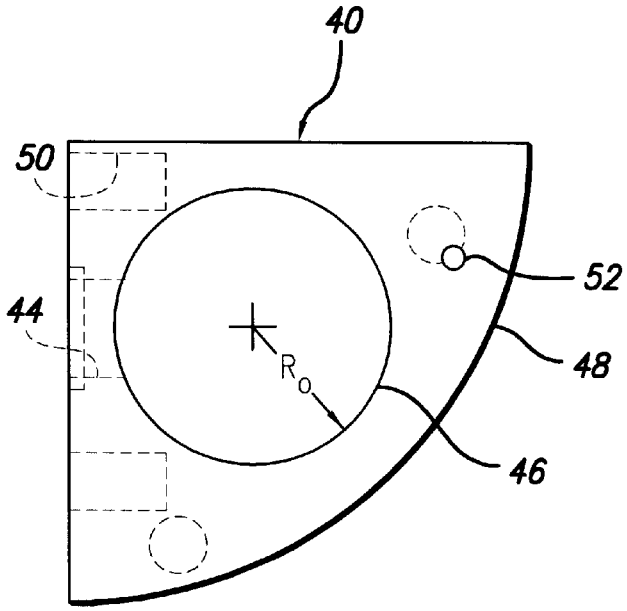
FIG. 8 is an end view of an exemplary heat sink according to the invention.
Figure 9:
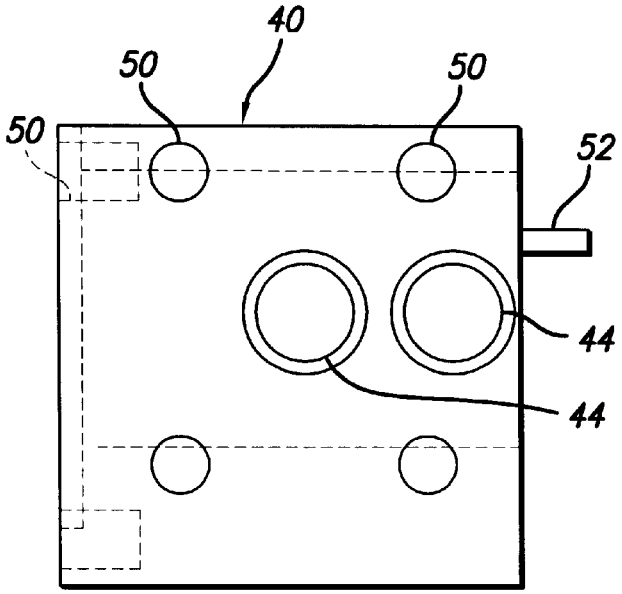
FIG. 9 is a side view of the heat sink shown in FIG. 8.

FIG. 8 is an end view of an exemplary heat sink according to the invention. FIG. 9 is a side view of the heat sink shown in FIG. 8. Cavity 46 has a radius nominally equally to the outer radius $r_o$ of the ceramic insulator 22. Cavity 46 is preferably configured as a vacuum chamber that may be sealed by brazing the end seals and power connector seals in place. In general, the heat sink is a relatively massive structural member that is configured to maintain compression on the electrode 22 and ceramic insulator 22 during operation of collector 20. Preferably, heat sink 40 is formed from a material having a coefficient of thermal expansion not greater than that of the electrode 22. For example, a molybdenum heat sink may be used with a molybdenum, molybdenum/copper, or copper electrode, and a copper heat sink may be used with a copper electrode. Other materials previously identified for the electrode may also be used, or any other suitable material.

At least one surface 48 of the heat sink 40 may be contoured to conform to an exterior surface of the device it will be installed in, for more efficient heat exchange. In general, the heat sink may have any other desired external shape. For example, it may include planar mounting surfaces or heat exchange fins, or may have a simple cylindrical outer surface, such as the outer surface of a cylindrical sleeve or canister. The heat sink may be provided with various surface features, such as fastener holes 50 and/or alignment pin 52, as needed. Openings 44 may be provided to permit access for the power connector assemblies 36, 37 which may be brazed to the heat sink for sealing the cavity 46.

Having thus described a preferred embodiment of collector assembly, it should be apparent to those skilled in the art that certain advantages of the within system have been achieved. It should also be appreciated that various modifications, adaptations, and alternative embodiments thereof may be made within the scope and spirit of the present invention. For example, a sleeveless assembly has been illustrated, but it should be apparent that the inventive concepts described above would be equally applicable to a collector assembly having a sleeve interposed between the ceramic core and the heat sink. The invention is further defined by the following claims.

What is claimed is:

1. A collector assembly for a linear beam device, the assembly comprising:

a heat sink comprised of a first material, the heat sink having a cavity therein configured to hold a vacuum;

an electrode comprised of a second material disposed inside the cavity; and a ceramic insulator disposed inside the cavity around the electrode and interposed between the electrode and the heat sink, configured to electrically insulate the electrode from the heat sink and to conduct heat from the electrode to the heat sink, wherein the ceramic insulator directly contacts the electrode and the heat sink throughout an operating temperature range of the collector.

2. The collector assembly of claim 1, wherein the electrode is not attached to the ceramic insulator.

3. The collector assembly of claim 1, wherein the ceramic insulator further comprises a plurality of sectors separated from one another by a plurality of gaps.

4. The collector assembly of claim 1, wherein the electrode further comprises a first stage and a second stage.

5. The collector assembly of claim 4, wherein the second stage does not have a probe and comprises a central conical recess.

6. The collector assembly of claim 4, further comprising an annular forward seal brazed to the ceramic insulator and to the heat sink adjacent to the first stage of the electrode at a front end of the assembly.

7. The collector assembly of claim 4, further comprising a rear seal brazed to the ceramic insulator and to the heat sink adjacent to the second stage of the electrode at a rear end of the assembly.

8. The collector assembly of claim 1, wherein the first material is molybdenum and the second material is molybdenum.

9. The collector assembly of claim 1, wherein the first material is copper and the second material is copper.

10. The collector assembly of claim 1, wherein the first material is molybdenum and the second material is selected from tungsten, carburized tungsten, an elconite material, or carbon.

11. The collector assembly of claim 10, wherein the elconite material is a sintered tungsten carbide material infiltrated with copper.

12. The collector assembly of claim 1, wherein the ceramic insulator is comprised of a material selected from beryllium oxide, aluminum nitride, or alumina.

13. The collector assembly of claim 1, wherein the first material is copper, the second material is copper, and the ceramic insulator is an aluminum nitride material.

14. The collector assembly of claim 1, further comprising a sleeve of a metallic material interposed between the ceramic insulator and the heat sink.

15. The collector assembly of claim 1, wherein an exterior surface of the heat sink is contoured to match an exterior surface of a device.

16. The collector assembly of claim 1, wherein an exterior surface of the heat sink is contoured to match an exterior surface of an airborne device.

17. The collector assembly of claim 1, wherein the ceramic insulator is compressed between the electrode and the heat sink at ambient temperature.

18. The collector assembly of claim 1, wherein the ceramic insulator is compressed between the electrode and the heat sink over a temperature range between not greater than 0° C. and not less than 250° C.

19. The collector assembly of claim 1, wherein the ceramic insulator directly contacts the electrode and the heat sink over a temperature range between not greater than 0° C. and not less than 250° C.

20. The collector assembly of claim 1, wherein the ceramic insulator comprises a segmented ceramic insulator.

21. A collector assembly for a linear beam device, the assembly comprising:

a heat sink comprised of a first material, the heat sink having a cavity therein configured to hold a vacuum;

an electrode comprised of a second material disposed inside the cavity; and a ceramic insulator disposed inside the cavity around the electrode and interposed between the electrode and the heat sink, configured to electrically insulate the electrode from the heat sink and to conduct heat from the electrode to the heat sink, wherein the ceramic insulator directly contacts the electrode and the heat sink throughout an operating temperature range of the collector.

22. The collector assembly of claim 21, wherein the ceramic insulator comprises a segmented ceramic insulator.

* * * * *